US007246629B2

(12) United States Patent
You

(10) Patent No.: US 7,246,629 B2
(45) Date of Patent: Jul. 24, 2007

(54) BEACH UMBRELLA

(76) Inventor: Ching-Chuan You, Rm. 532, 5FL. No. 144, Ming Chuan E. Rd., Sec. 3, P.O. Box 1-79, Taipei (TW) 105

( * ) Notice: Subject to any disclaimer, the term of this patent is extended or adjusted under 35 U.S.C. 154(b) by 0 days.

(21) Appl. No.: 11/175,286

(22) Filed: Jul. 7, 2005

(65) Prior Publication Data

US 2007/0006905 A1 Jan. 11, 2007

(51) Int. Cl.
*A45B 25/00* (2006.01)

(52) U.S. Cl. ..... 135/29

(58) Field of Classification Search ..... 135/15.1, 135/29, 32, 25.1, 25.3, 25.31, 25.4, 25.41, 135/31

See application file for complete search history.

(56) References Cited

U.S. PATENT DOCUMENTS

| | | | | | |
|---|---|---|---|---|---|
| 2,068,067 | A * | 1/1937 | Okun | 135/25.31 |
| 2,711,182 | A * | 6/1955 | Kiel et al. | 135/25.31 |
| 4,834,126 | A * | 5/1989 | Sweet, Jr. | 135/15.1 |
| 5,011,319 | A * | 4/1991 | Levi et al. | 403/109.5 |
| 5,370,144 | A * | 12/1994 | Yang | 135/25.31 |
| 5,372,155 | A * | 12/1994 | You | 135/29 |
| 5,494,065 | A * | 2/1996 | Kuo et al. | 135/31 |
| 5,564,449 | A * | 10/1996 | Lin et al. | 135/24 |
| 5,715,853 | A * | 2/1998 | Lin | 135/29 |
| 6,394,115 | B1 * | 5/2002 | Tsun | 135/25.3 |
| D476,713 | S * | 7/2003 | You | D21/839 |
| 6,619,877 | B1 * | 9/2003 | Huang | 403/351 |
| 6,789,556 | B2 * | 9/2004 | You | 135/31 |
| 2002/0189655 | A1 * | 12/2002 | You | 135/25.1 |
| 2004/0099295 | A1 * | 5/2004 | You | 135/16 |
| 2004/0226591 | A1 * | 11/2004 | You | 135/25.1 |

FOREIGN PATENT DOCUMENTS

| | | |
|---|---|---|
| TW | 241469 | 2/1995 |
| TW | 270295 | 2/1996 |

* cited by examiner

*Primary Examiner*—David Dunn
*Assistant Examiner*—Noah Chandler Hawk

(57) ABSTRACT

One embodiment of a beach umbrella comprises a telescopic shank and a folding radial frame including ribs each including a first segment, a second segment, and a hinge pivotably interconnecting the segments, and spreaders each having one end pivotably connected to the first segment and the other end pivotably connected to a ring on the shank. The segments are substantially parallel in response to folding the hinges. The shank includes an upper support tube, a lower sliding tube adapted to slide in the support tube, and a rotatable locking device fixedly provided on a top of the sliding tube. The sliding tube is adapted to manually raise or lower to a plurality of vertical positions relative to the support tube, and the sliding tube is adapted to be locked in a selected one of the vertical positions.

10 Claims, 12 Drawing Sheets

BEACH UMBRELLA

BACKGROUND OF THE INVENTION

1. Field of Invention

The present invention relates to beach umbrellas and more particularly to such a beach umbrella having advantages of having a minimum space after folding and being capable of carry out a segment-less length adjustment of shank.

2. Description of Related Art

Conventionally, a beach umbrella is simply an enlargement of an umbrella available in the market. The beach umbrella comprises a folding radial frame, a canopy stretched over the frame, and a threadedly connected shank having a pointed end adapted to insert into sand for fastening.

However, the prior beach umbrella suffered from several disadvantages. For example, segments of the shank are detachable. Thus, persons tend to forget to bring one or more shank segments after folding same and leaving beach. Further, segment-less adjustment of length of the shank is not provided. Thus, some people may not satisfy with the length adjustment feature. Furthermore the shank has a large diameter and a thick wall. Thus, a retraction mechanism as implemented in prior umbrella shank with a small diameter and a thin wall is not applicable for the beach umbrella. In addition, no hinge is provided in the rib. Thus, storage reduction of the beach umbrella is limited after folding.

Taiwanese Utility Model Patent No. 110,544 (publication No. 270295) discloses a beach umbrella frame comprising a cylindrical shank having a bottom extension, a plurality of ribs each including three segments, a plurality of spreaders each including two segments, a first hinge pivotably interconnecting first and second rib segments, and a second hinge pivotably interconnecting second and third segments. The storage reduction of the folded beach umbrella is somewhat improved and it is easy to carry after folding.

Taiwanese Utility Model Patent No. 98,904 (publication No. 241469) discloses a fastening mechanism for beach umbrella. It is characterized in that the shank segments are threadedly secured together, and each rib including a first segment, a second segment, and a hinge pivotably interconnecting first and second segments. In a fully stretched position of the umbrella, the ribs are fastened by the hinges.

However, both patents still have the problems of people tending to forget to bring one or more shank segments after folding same and leaving beach, the length adjustment feature of the shank being unsatisfactory, and limited storage reduction after folding. As mentioned above, both of their rib and hinge between each two interconnecting segments are made of metal. The hinge between two segments of rib is secured by rivet. The rivet fastening is a time consuming and a low yield process, the quality of the joint is not reliable, for example caused by rust, will cause jam of an umbrella. Thus, the need for improvement still exists.

SUMMARY OF THE INVENTION

It is therefore an object of the present invention to provide a beach umbrella wherein rib segments are substantially parallel in response to folding the umbrella so as to greatly decrease a storage space.

It is another object of the present invention to provide a beach umbrella having durable components made of FRP (Fiberglass Reinforced Plastic) and which can be mass produced easily.

It is a further object of the present invention to provide a beach umbrella comprising a telescopic shank including an upper support tube, a lower sliding tube adapted to slide in the support tube, and a rotatable locking device fixedly provided on a top of the sliding tube wherein the sliding tube is adapted to manually raise or lower to a plurality of vertical positions relative to the support tube, and the sliding tube is adapted to be locked in any selected one of the vertical positions. By utilizing this, the prior problem of people tending to forget to bring one or more shank segments after folding the same and leaving beach can be solved. Further, a segment-less shank length adjustment is carried out.

The above and other objects, features and advantages of the present invention will become apparent from the following detailed description taken with the accompanying drawings.

DETAILED DESCRIPTION OF THE INVENTION

Figure 1:
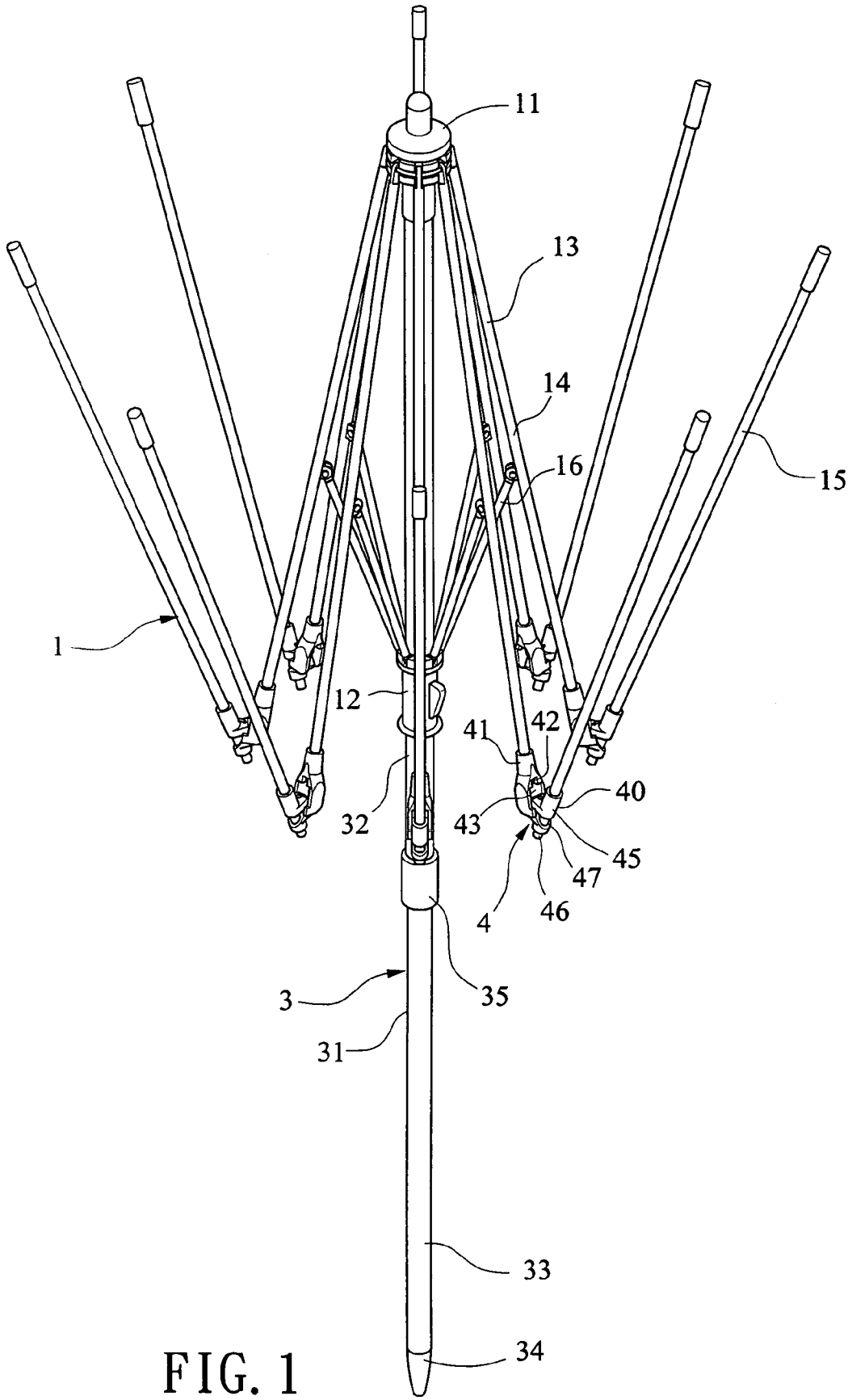
FIG. 1 is a perspective view of a first preferred embodiment of beach umbrella frame according to the invention, where the frame is partially folded.
Figure 2:
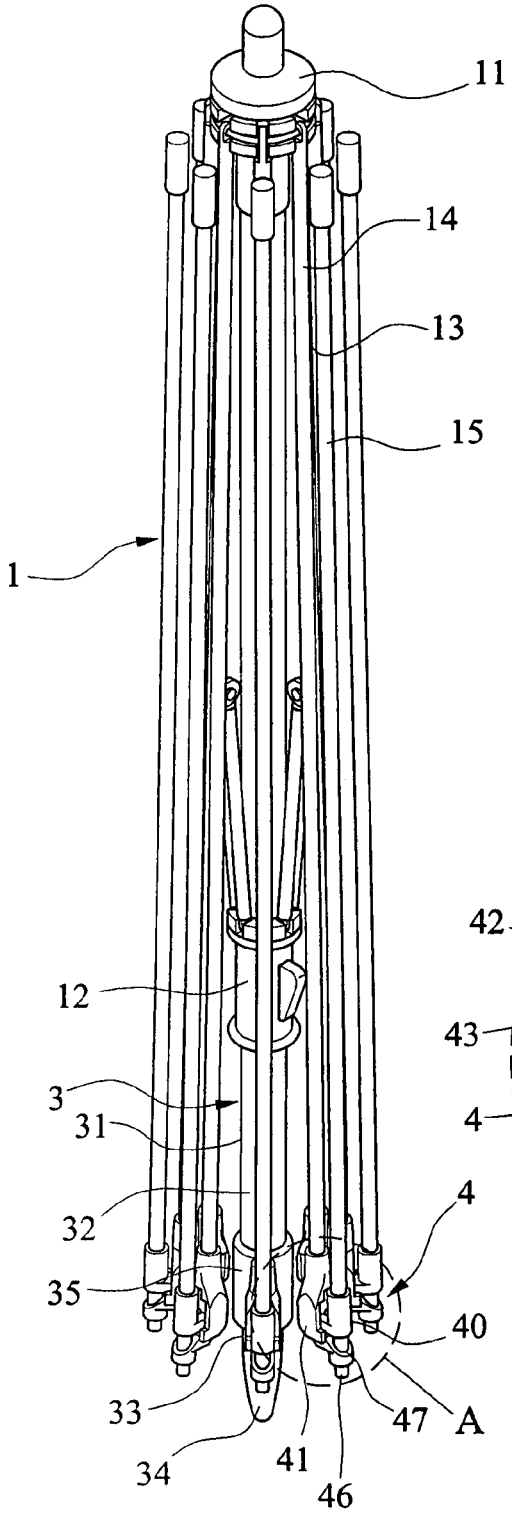
FIG. 2 is a perspective view of the fully folded frame shown in FIG. 1.
Figure 2A:
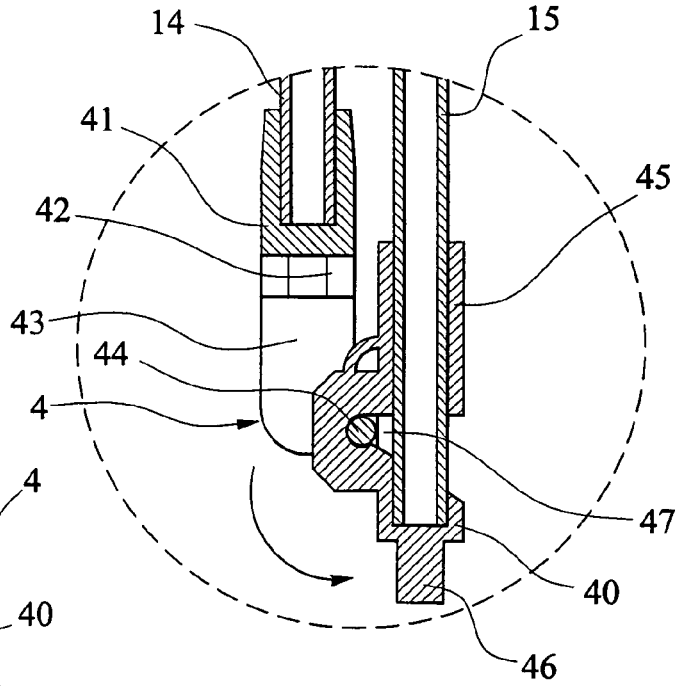
FIG. 2A is a detailed view of the area in circle in FIG. 2.
Figure 3:
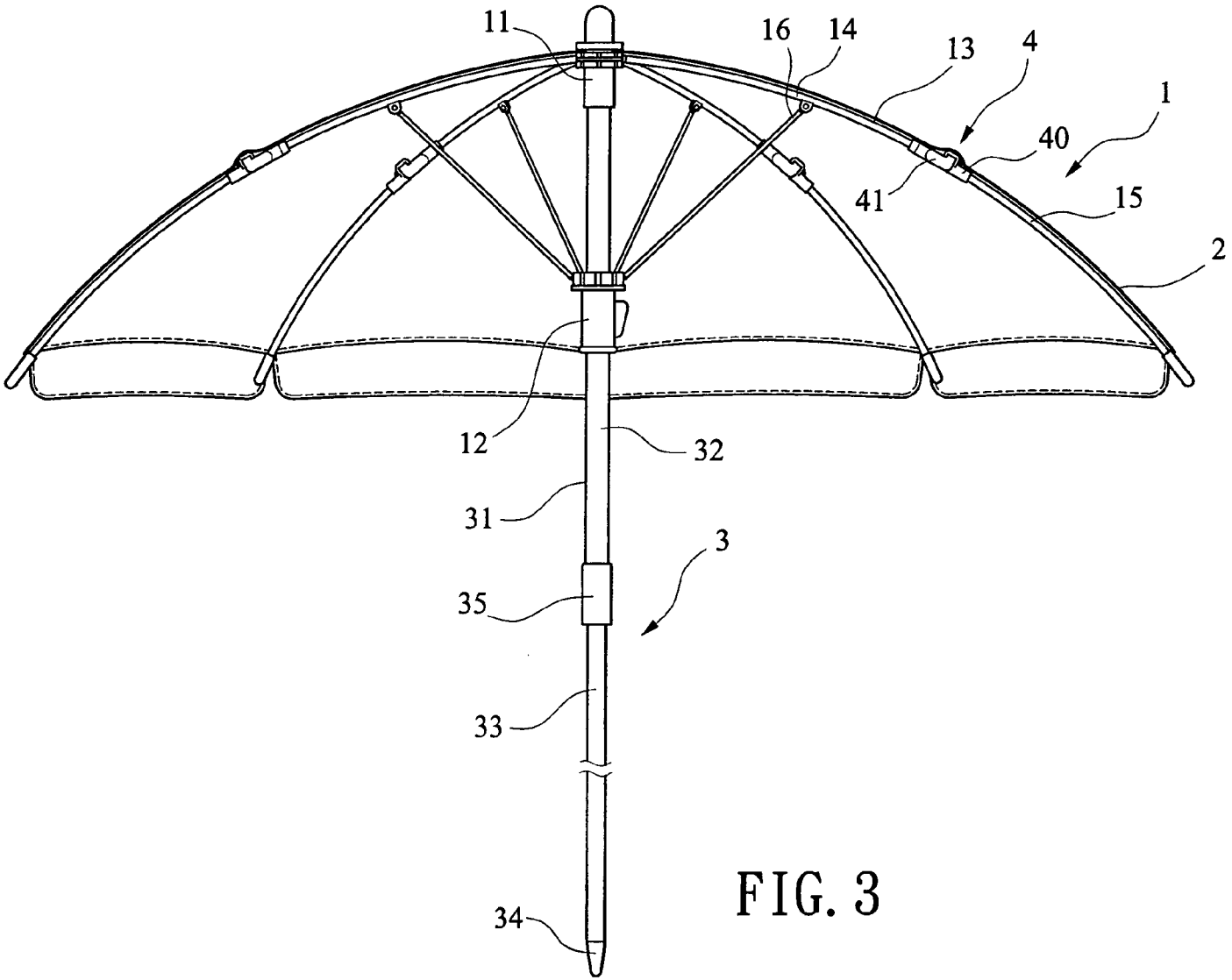
FIG. 3 is a side view of the fully open frame with canopy stretched thereover.
Figure 5:
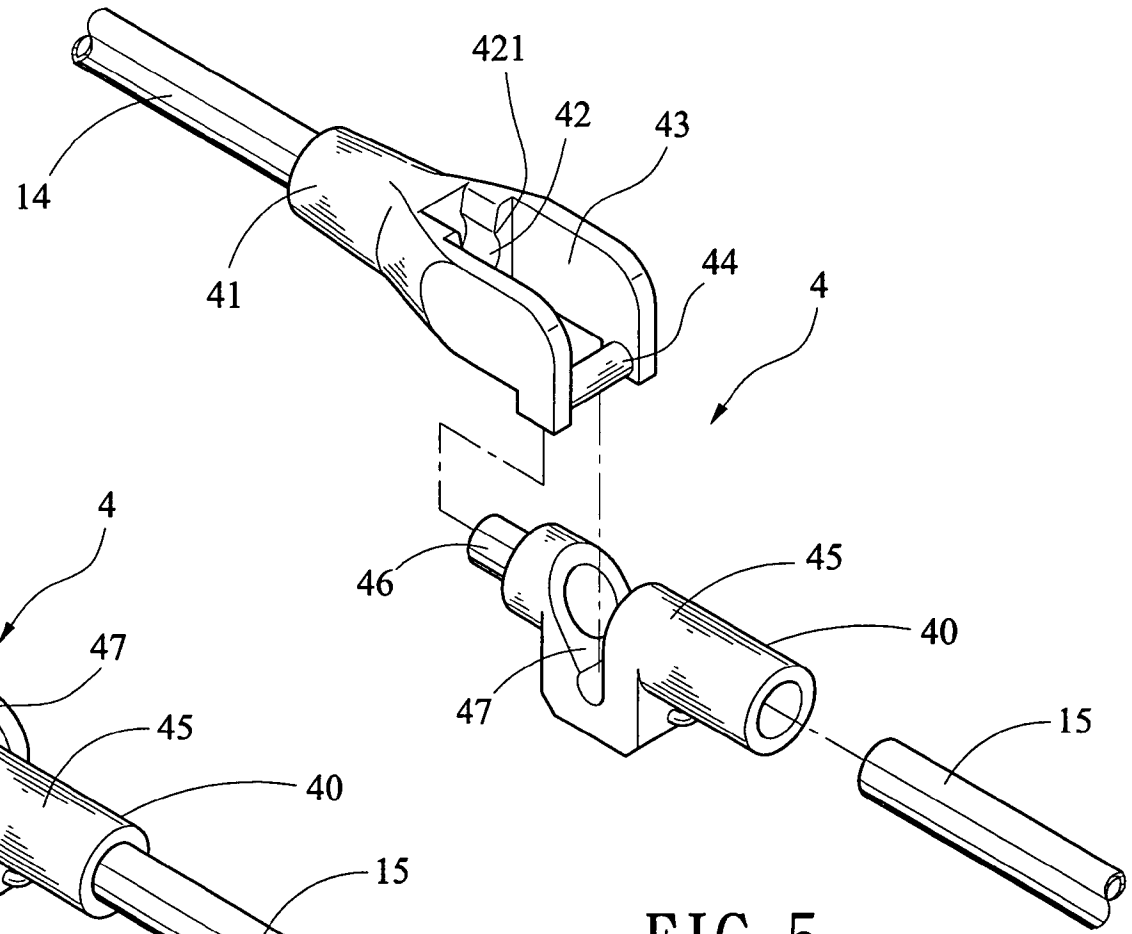
FIG. 5 is an exploded view of the hinge shown in FIG. 4.
Figure 4:
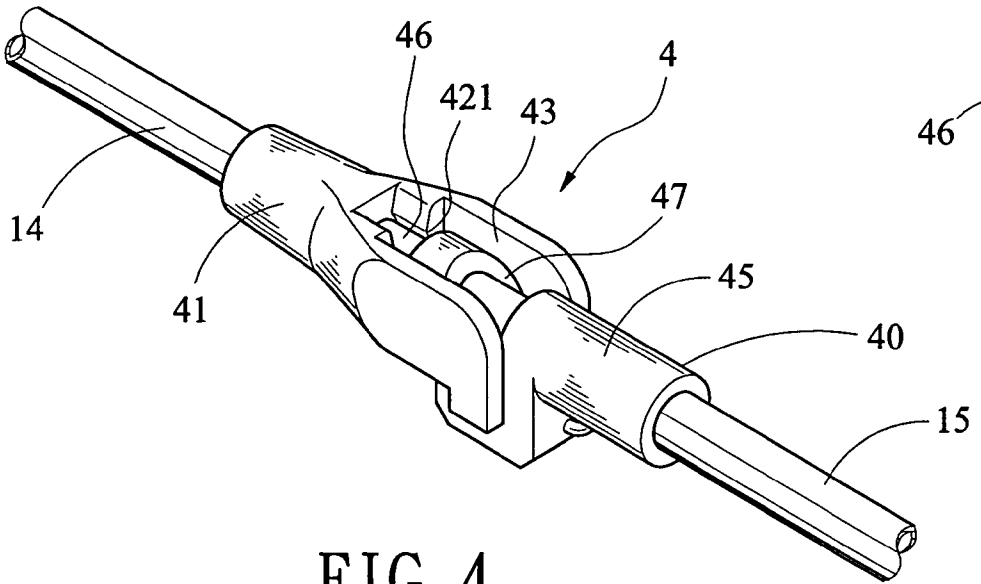
FIG. 4 is a perspective view of hinge in its extended position in accordance with the present invention.

Referring to FIGS. 1 to 15, a beach umbrella in accordance with a first preferred embodiment of the invention is shown. The umbrella comprises a folding radial frame 1, a canopy 2 stretched over the frame 1, and a telescopic shank mechanism 3. Each component is discussed in detailed below.

The frame 1 comprises a hub 11 provided on a top of the shank mechanism 3, a ring 12 slidably provided on the shank mechanism 3 below the hub 11, a plurality of ribs 13 each made of FRP (Fiberglass Reinforced Plastic) and including a first segment 14, a second segment 15, and a hinge 4 pivotably interconnecting the first segment 14 and the second segment 15, and a plurality of spreaders 16 each having one end pivotably connected to an intermediate portion of the first segment 14 and the other end pivotably connected to the ring 12. Fully sliding the ring 12 upward along the shank mechanism 3 to extend the ribs 13 and the canopy 2 until being locked will open the umbrella (see FIG. 3).

Figures 6A, 6B, 6C:
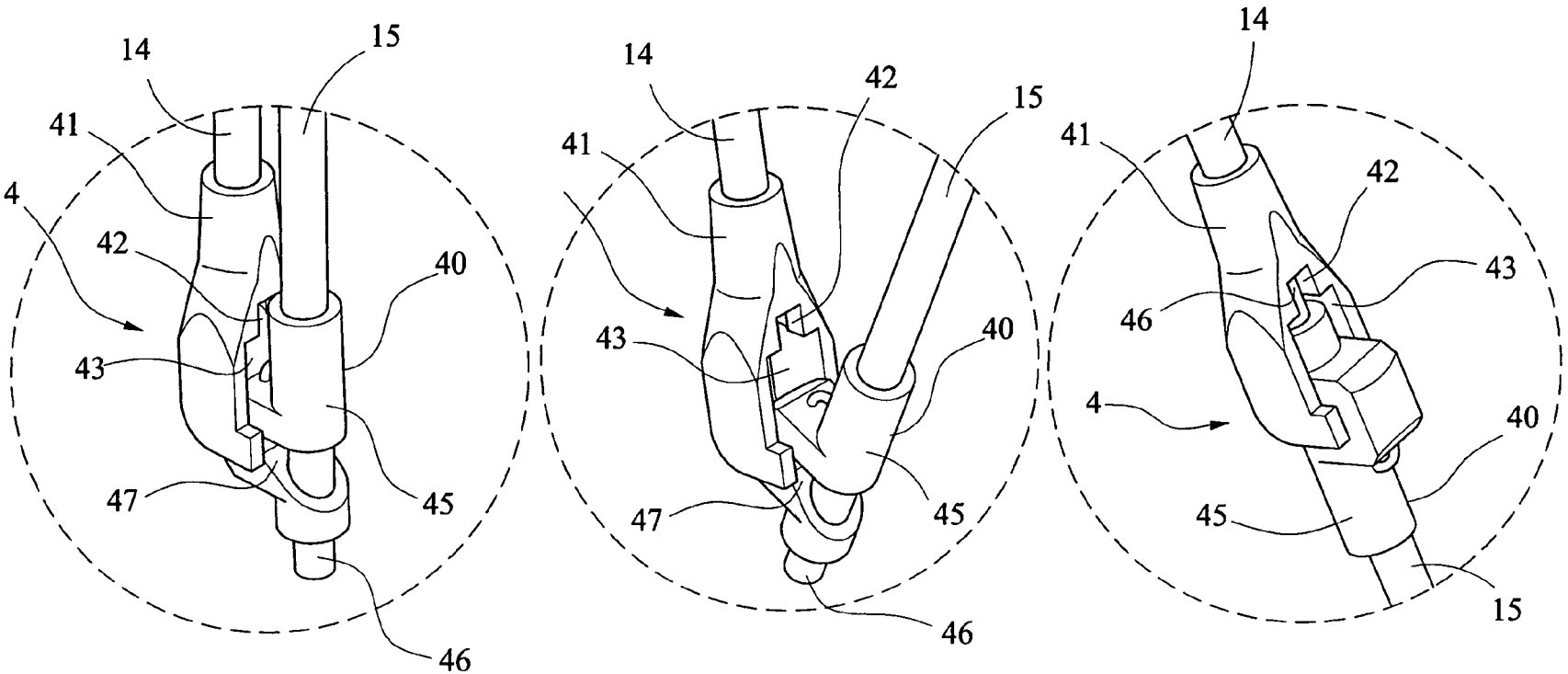
FIGS. 6A, 6B, and 6C are perspective views showing steps of extending the folded hinge.
Figure 7:
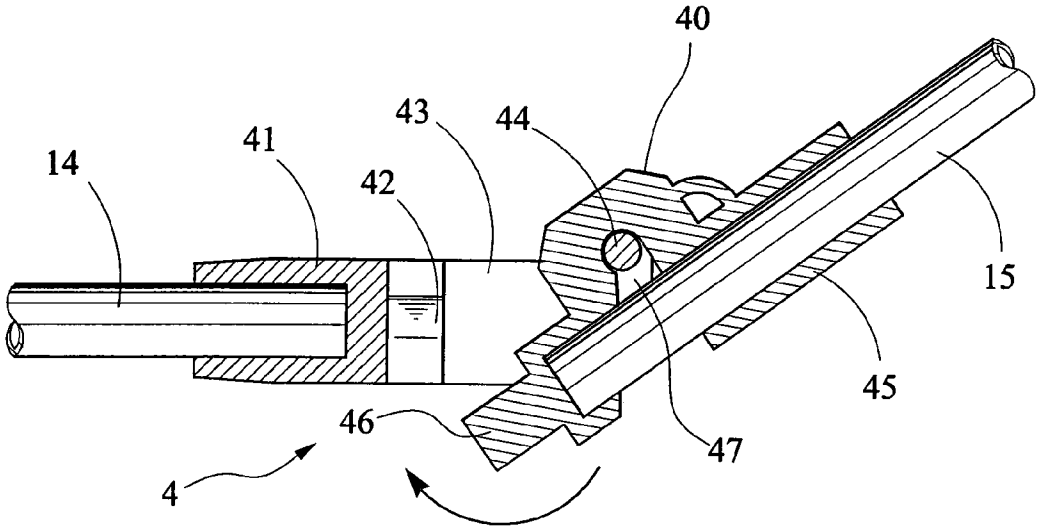
FIG. 7 is a sectional view of the hinge being extended.
Figure 8A:
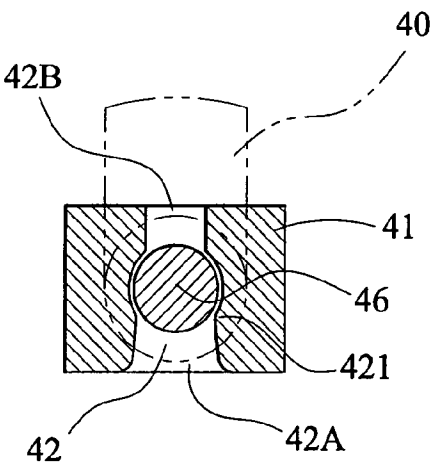
FIG. 8A is a sectional view taken along line A—A of FIG. 8.
Figure 8:
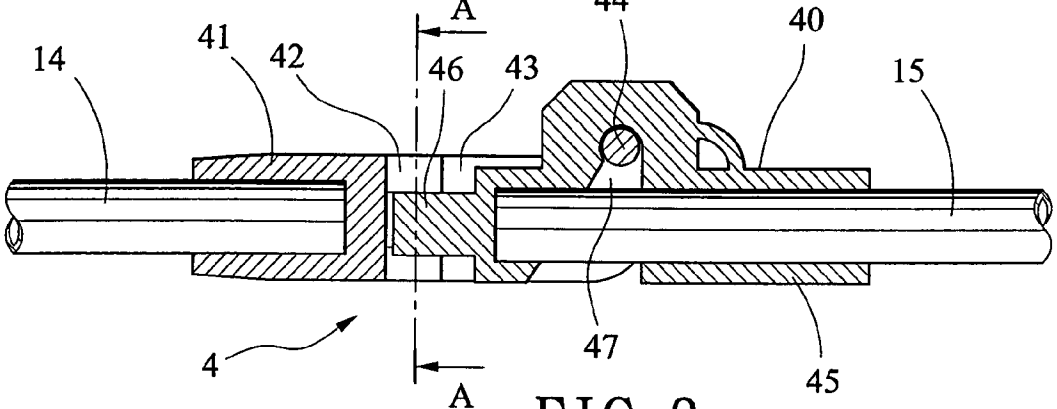
FIG. 8 is a sectional view of the extended hinge.
Figure 9:
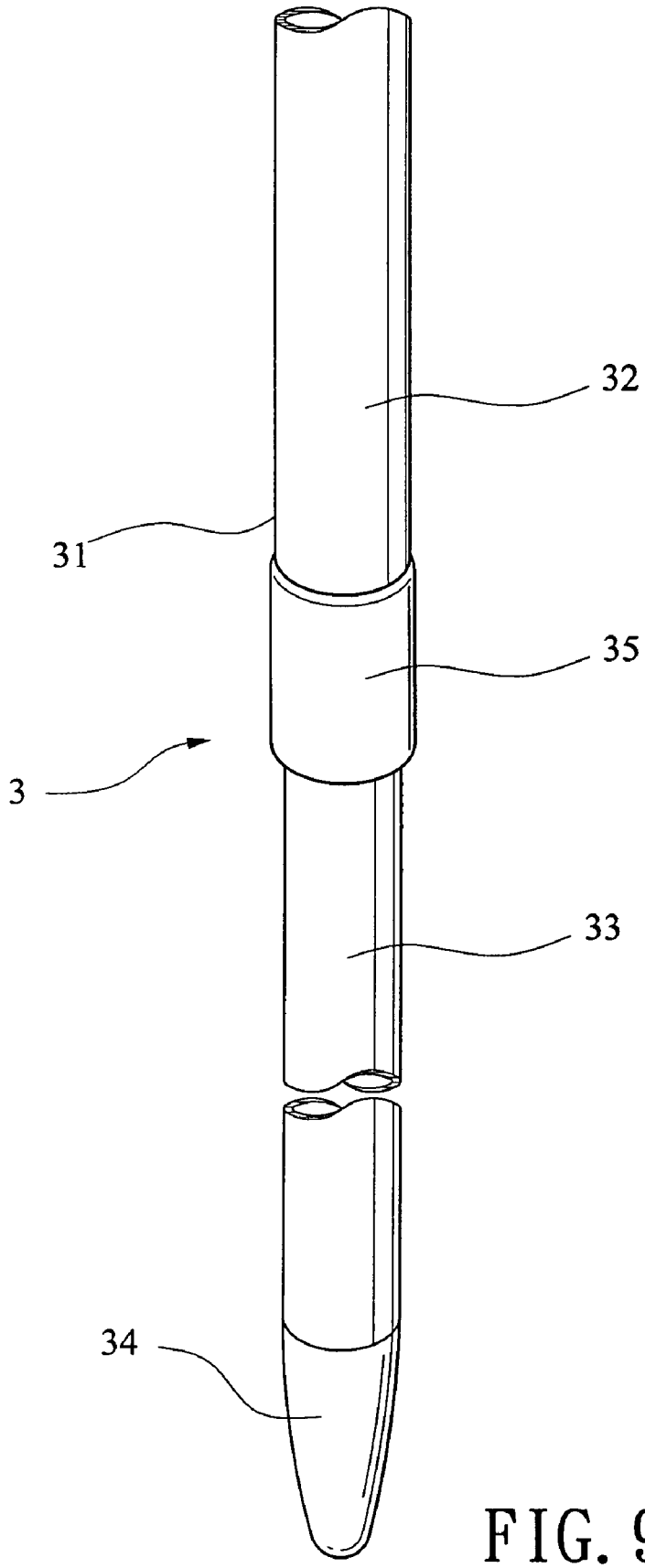
FIG. 9 is a perspective view of the umbrella shank mechanism.

The hinge 4 comprises a first unit 41 and a second unit 40. Both are made of plastic. The Y-shaped first unit 41 has one end fixedly received the first segment 14 and comprises a tunnel 42 opposing one end, a narrow locking opening 421 in communication with the tunnel 42, a bar 44 across an opening of a bifurcation of the first unit 41, and a channel 43 defined by the bifurcation and the bar 44. The bar 44 is not aligned with a center line of the channel 43 and tunnel 42 of the first unit 41. The tunnel 42 has a larger opening 42A and a smaller opening 42B each in communication with one of two opposite peripheral portions of the tunnel 42, as shown in FIG. 8A, the opening 42A has a width larger than a diameter of the extension 46, and the narrow locking opening 421 has two arcuate necks each formed at a joining portion of the tunnel 42 and the larger opening 42A. The width of the larger opening 42A is larger than that of the smaller opening 42B. The second unit 40 has a section of U and comprises a cylindrical extension 46 projected from one end, an intermediate recess 47 having an arcuate section in its bottom, and a bore 45 through the other end and the recess 47 and terminated at one end proximate the extension 46. The recess 47 is adapted to receive the bar 44 with the extension 46 disposed in the tunnel 42 by snapping. One end of the second segment 15 is fixedly inserted into the bore 45 for confining the bar 44 in the recess 47. This forms a pivotal connection of the first unit 41 and the second unit 40. Thus, a user may extend the folded ribs 13 by pivoting from a position shown in FIG. 6A (i.e., the first segment 14 and the second segment 15 are substantially parallel) to a position shown in FIG. 6C (i.e., the first segment 14 and the second segment 15 form a straight line). Also, as shown in FIG. 8A, the extension 46 is stopped at the narrow locking opening 421 (i.e., positioned) when the rib 13 is extended. It is obvious that for folding the rib 13, the steps discussed with reference to FIGS. 6A to 6C are traversed in the opposite direction. Advantageously, the first segment 14 and the second segment 15 are substantially parallel in the folded position of the umbrella. Thus, a minimum storage space of the umbrella can be obtained.

Referring to FIGS. 9 to 15 specifically, the shank mechanism 3 is implemented as a center pole 31 being made of plastic and including an upper support tube 32, a lower sliding tube 33, and a rotatable locking device 6 fixedly provided on a top of the sliding tube 33. The locking device 6 is adapted to slide in the support tube 32 as the sliding tube 33 slides in the support tube 32.

A sleeve 35 is put on a lower portion of the support tube 32. The sleeve 35 includes an inward extending rim 351 having an inner diameter smaller than that of the support tube 32 with a bottom of the support tube 32 rested on a top annular surface of the rim 351 such that the support tube 32 and the sliding tube 33 are prevented from separating while sliding the sliding tube 33.

Figure 10:
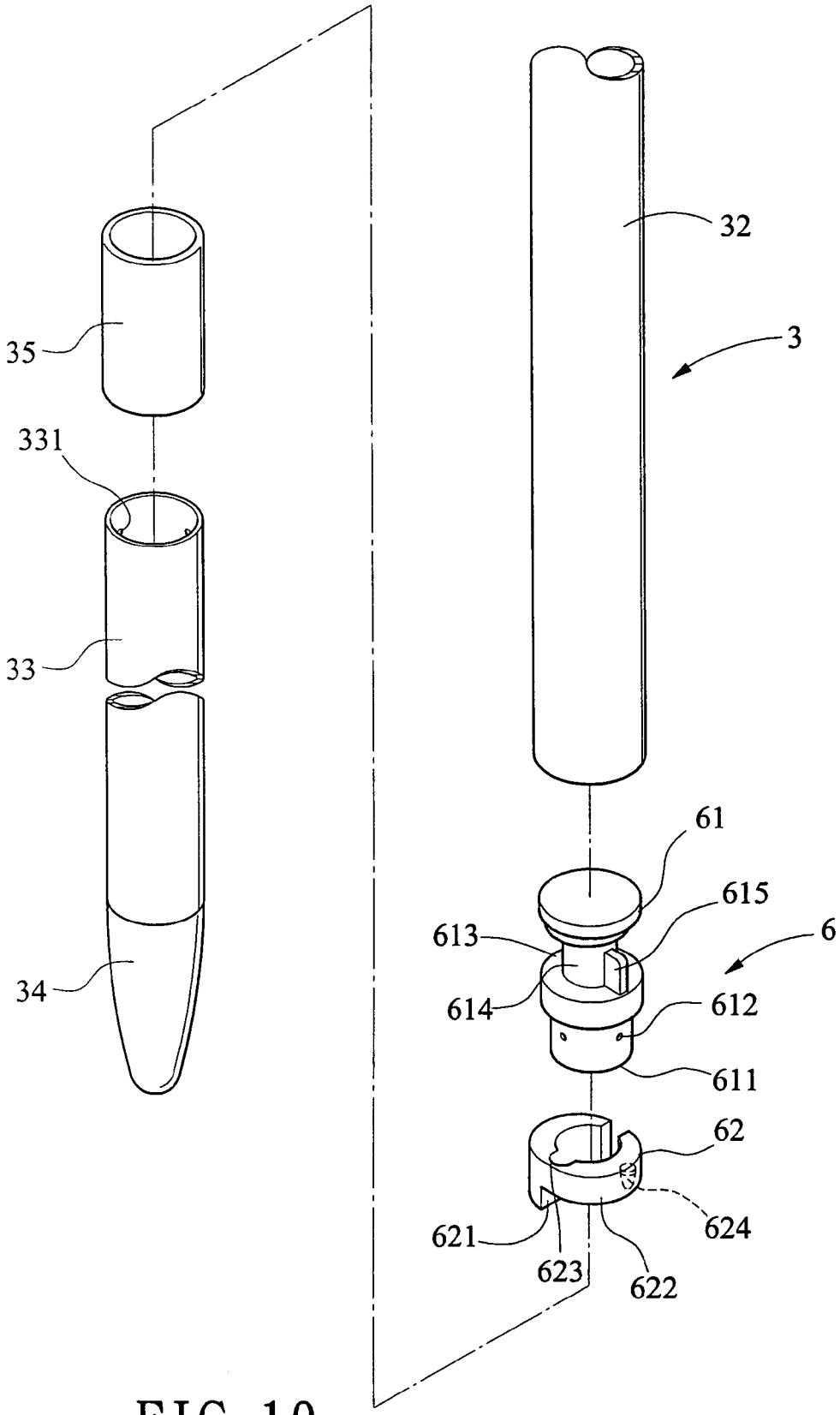
FIG. 10 is an exploded view of the shank mechanism shown in FIG. 9.
Figure 11:
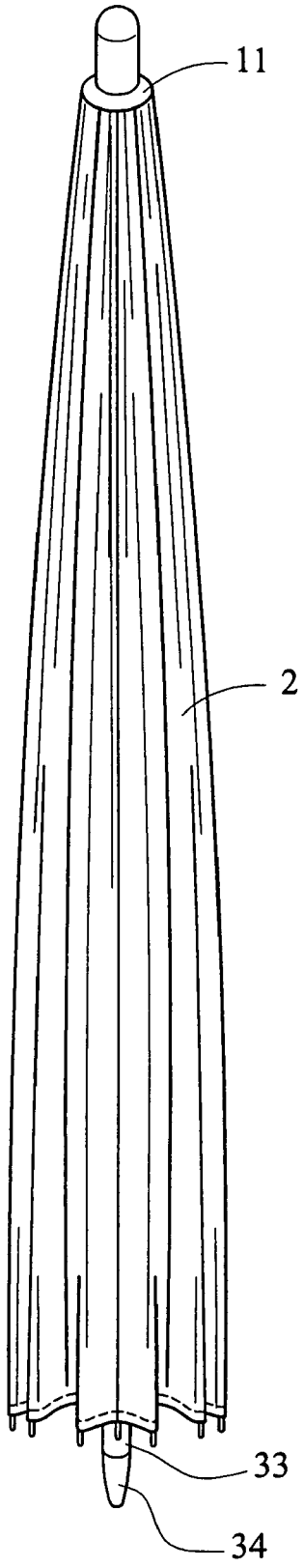
FIG. 11 is a perspective view of an umbrella incorporating the frame of the invention, where the umbrella is fully folded.

As shown in FIG. 10, the locking device 6 comprises a barbell-shaped member 61 sized to slidably fit in the support tube 32. The barbell-shaped member 61 includes a lower cylindrical extension 611, a plurality of cavities 612 equally spaced around the extension 611, the cavities 612 being adapted to matingly engage a plurality of projections 331 proximate a top of the sliding tube 33 such that the barbell-shaped member 61 and the sliding tube 33 are secured together, an eccentric shaft 614 interconnected two enlargements, an annular groove 613 formed around the shaft 614, and a protrusion 615 formed on a shoulder between the shaft 614 and the lower enlargement. The locking device 6 further comprises a flexible C-shaped member 62 having an outer diameter smaller than that of the barbell-shaped member 6. The C-shaped member 62 has an eccentric shape and is fitted around the shaft 614. The C-shaped member 62 comprises an arcuate thick portion 621, an arcuate thin portion 622, a recessed flexible connection 623 interconnected the portions 621 and 622, and a stop 624 on an inner wall of the thin portion 622 proximate an opening of the C-shaped member 62.

Figure 12:
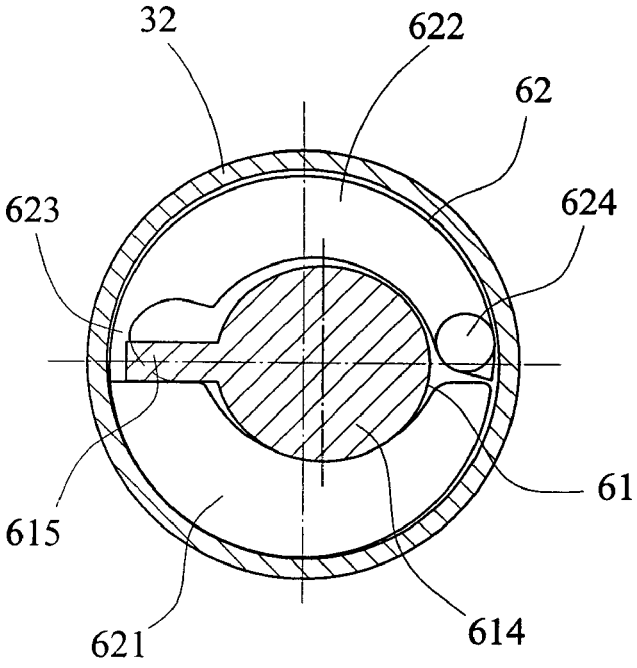
FIG. 12 is a transverse sectional view showing the shank mechanism and a locking device, where the shank mechanism is fully extended.
Figure 13:
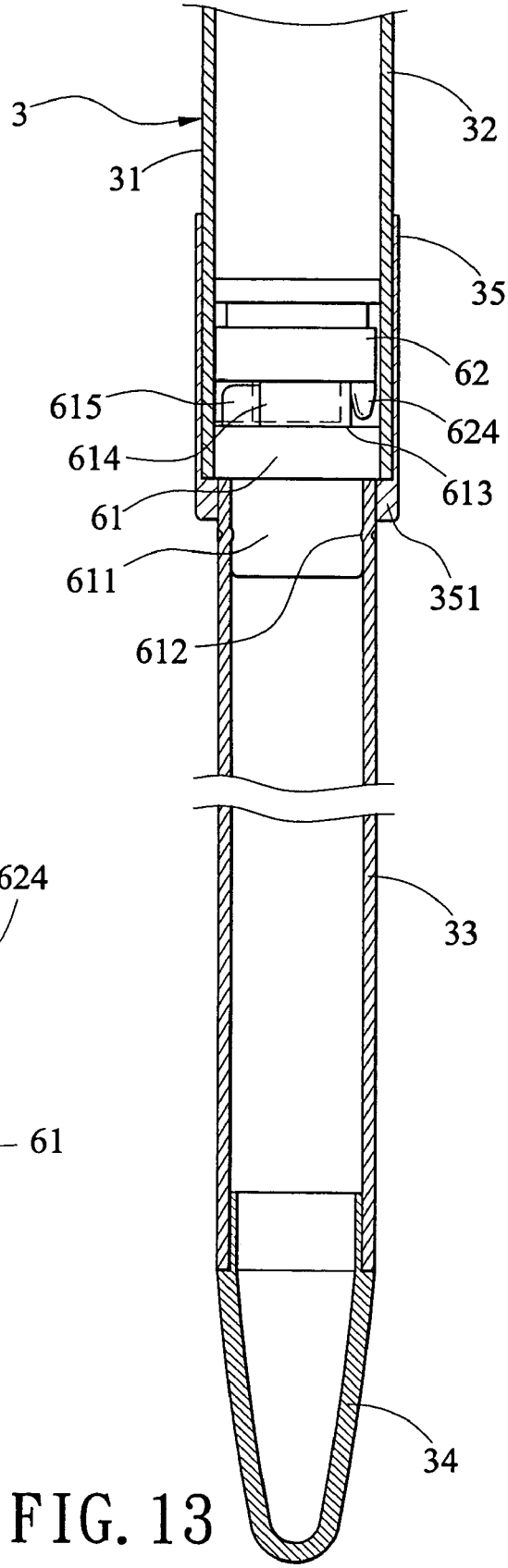
FIG. 13 is a longitudinal sectional view of the components shown in FIG. 12.
Figure 14:
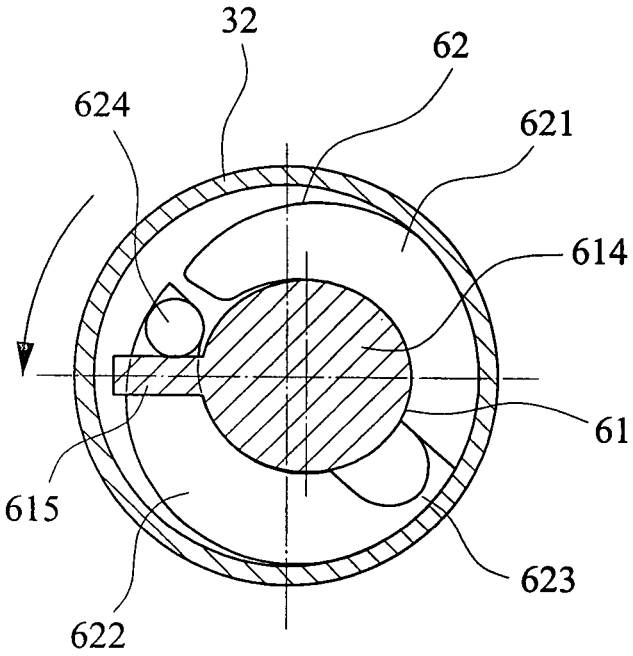
FIG. 14 is a transverse sectional view showing the shank mechanism and a locking device, where the shank mechanism is retracting.

Referring to FIGS. 11 to 15 specifically, in a case of the sliding tube 33 retracted within the support tube 32, a user may clockwise rotate the sliding tube 33 (i.e., also rotate the barbell-shaped member 61) to dispose the stop 624 and the protrusion 615 at opposite sides of the shaft 614, i.e., the C-shaped member 62 is spaced from an inner surface of the support tube 32 by a gap without interference therebetween (see FIG. 12). At this position, the sliding tube 33 is free to slide in the support tube 32 for extending or retracting in order to adjust height (see FIGS. 12 and 13). Also, a pointed end 34 formed on a lower end of the sliding tube 33 is adapted to insert into sand or earth for fastening the umbrella.

Figure 15:
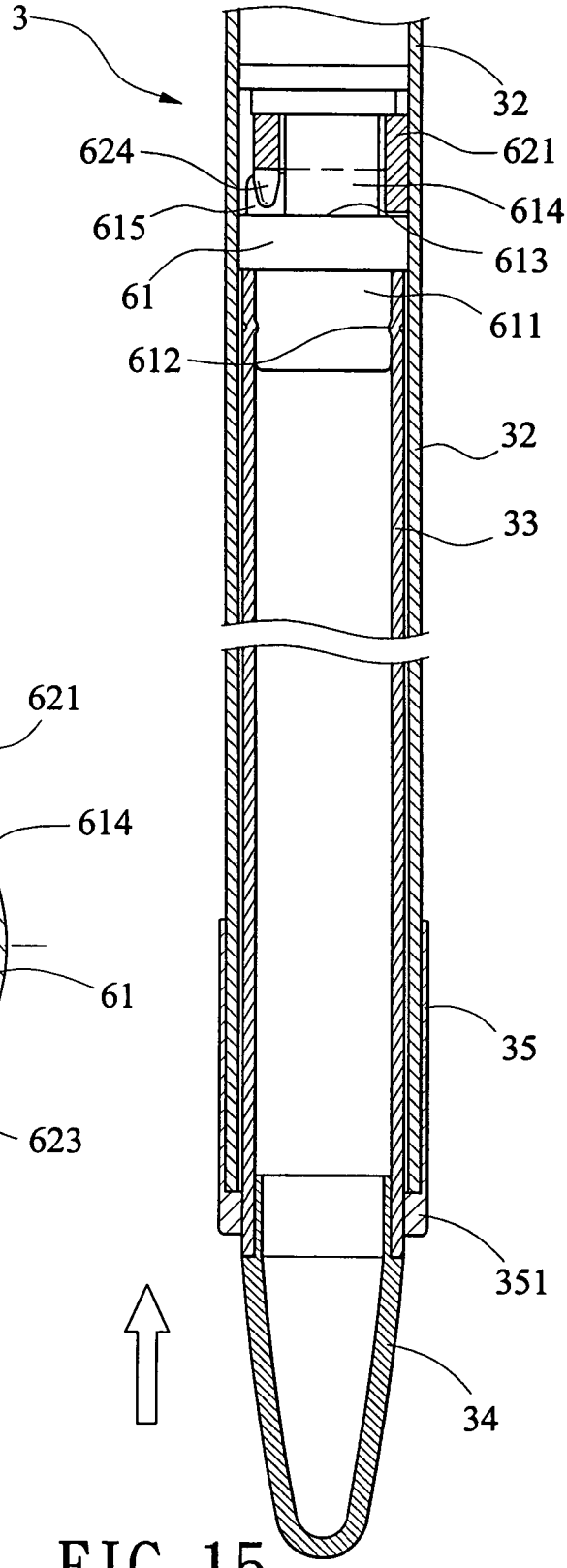
FIG. 15 is a longitudinal sectional view of the components shown in FIG. 14.

After a desired height of the shank mechanism 3 (i.e., the center pole 31) is obtained, a user may turn the sliding tube 33 relative to the support tube 32 about half circle until the protrusion 615 is stopped by the stop 624. Also, a portion of the C-shaped member 62 is pushed by the shaft 614 to urge against the inner surface of the support tube 32 (see FIG. 14). At this position, a relative rotation of the sliding tube 33 about the support tube 32 is prohibited. Thus, it is possible of adjusting height of the center pole 31 in a segment-less manner as shown in FIG. 15.

For retracting the center pole 31, the steps discussed above are traversed in the opposite direction including rotating the support tube 32 to loosen the barbell-shaped member 61 and the C-shaped member 62, retracting the sliding tube 33 into the support tube 32 until being stopped, and folding the frame 1 (i.e., ribs 13) by manipulating the hinges 4. As a result, a folded umbrella with minimum space is obtained.

Figure 16:
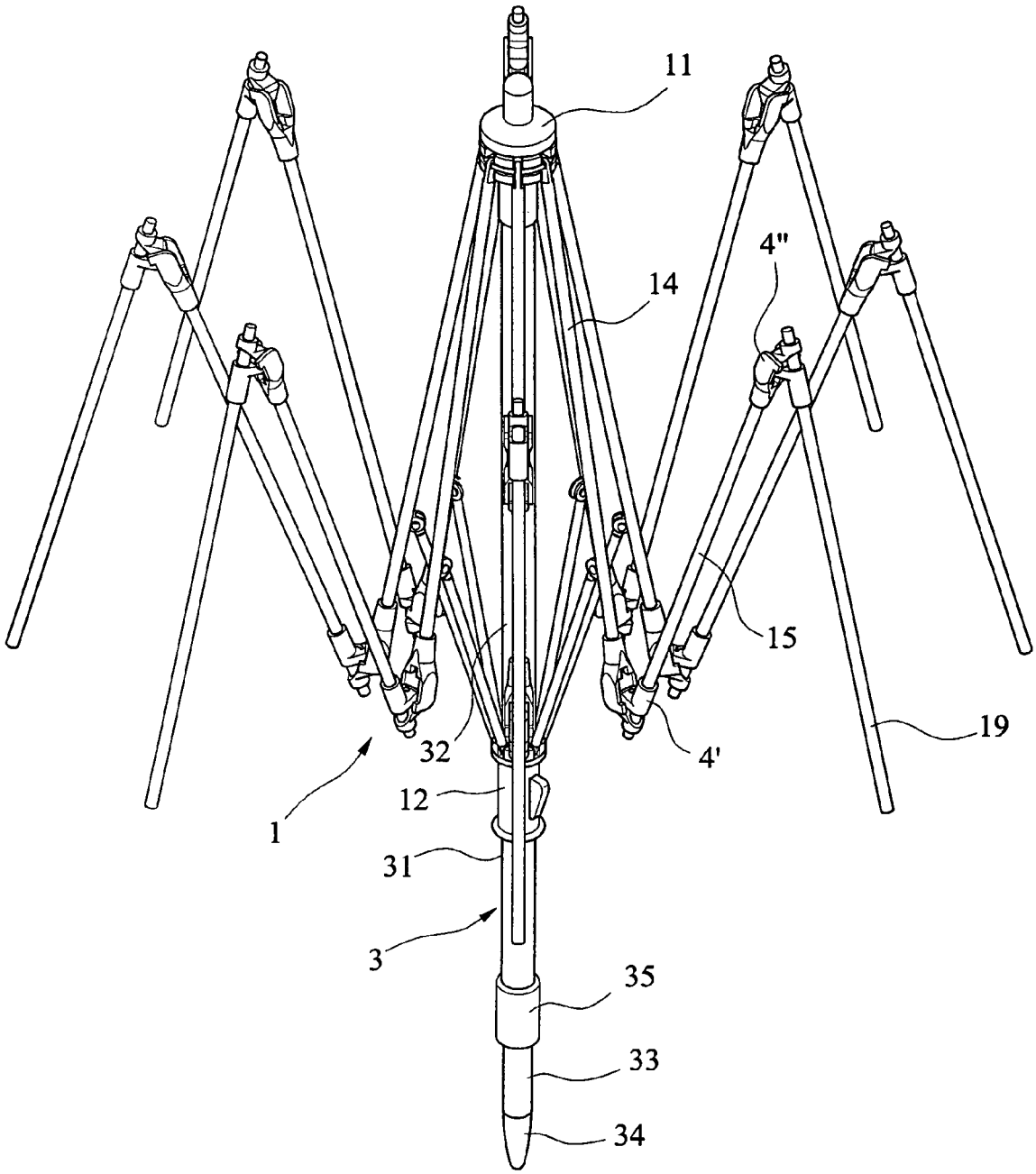
FIG. 16 is a perspective view of a second preferred embodiment of beach umbrella frame according to the invention, where the frame is partially folded.

Referring to FIG. 16, a beach umbrella in accordance with a second preferred embodiment of the invention is shown. The second preferred embodiment substantially has same structure as the first preferred embodiment. The differences between the first and the second preferred embodiments, i.e., the characteristics of the second preferred embodiment are detailed below. Each rib 13 consists of three segments, namely, a first segment 14, a second segment 15, and a third segment 19. Also, there are provided a first hinge 4' pivotably interconnecting the first and second segments 14 and 15, and a second hinge 4" pivotably interconnecting the second and third segments 15 and 19. The second embodiment is characterized in that a further space reduction of the folded umbrella is obtained.

While the invention herein disclosed has been described by means of specific embodiments, numerous modifications and variations could be made thereto by those skilled in the art without departing from the scope and spirit of the invention set forth in the claims.

What is claimed is:

1. A beach umbrella comprising:

a folding radial frame;

a canopy stretched over the frame;

a telescopic shank, wherein:

the frame includes a hub provided on a top of the shank, a ring slidably provided on the shank below the hub, a plurality of ribs each including a first segment, a second segment, and a hinge made of plastic and pivotably interconnecting the first and the second segments, and a plurality of spreaders each having one end pivotably connected to the first segment and the other end pivotably connected to the ring wherein the first and the second segments are substantially parallel in response to folding the hinges in a folding position of the frame;

the shank is made of plastic and includes an upper support tube, a lower sliding tube adapted to slide in the support tube, and a rotatable locking device provided on a top of the sliding tube wherein the sliding tube is adapted to manually raise or lower to a plurality of vertical positions relative to the support tube, and the sliding tube is adapted to be locked in a selected one of the vertical positions;

wherein the hinge is made of plastic and includes a first unit and a second unit, the first unit having one end fixedly connected to a free end of the first segment, and the second unit having one end pivotably connected to an other end of the first unit and an other end thereof fixedly connected to one end of the second segment;

wherein the first unit is substantially Y-shaped and includes a tunnel having a bifurication extending to opposing one end, a bar across an opening of the bifurication, and a channel defined by the bifurcation and the bar;

wherein the bar is not aligned with a center line of the channel and tunnel of the first unit; and wherein the tunnel has a larger opening and a smaller opening each in communication with the tunnel.

2. The beach umbrella of claim 1, wherein the first unit further includes a narrow locking opening in communication with the tunnel for positioning the second unit in an extended state of the hinge.

3. The beach umbrella of claim 2, wherein the narrow locking opening has two arcuate necks each formed at a joining portion of the tunnel and the larger opening.

4. The beach umbrella of claim 2, wherein the second unit is substantially of U-section and includes a cylindrical extension projected from one end, an intermediate recess having an arcuate section in its bottom, the recess being adapted to receive the bar with the extension disposed in the tunnel and stopped by the narrow locking opening, and a bore through the other end and the recess and terminated at one end proximate the extension, the bore being adapted to fixedly receive one end of the second segment for confining the bar in the recess.

5. The beach umbrella of claim 4, wherein the locking device is fixedly provided on the top of the sliding tube and is concealed by the support tube, the locking device includes a barbell-shaped member sized to slidably fit in the support tube, the barbell-shaped member including a lower cylindrical extension matingly secured to the top of the sliding tube, an eccentric shaft interconnected its top and bottom enlargements, and a protrusion formed on a shoulder between the shaft and the bottom enlargement; and a flexible, eccentric C-shaped member fitted around the shaft;

wherein the C-shaped member further includes an arcuate thick portion, an arcuate thin portion, a recessed flexible connection interconnected the thick and the thin portions, and a stop on an inner wall of the thin portion proximate an opening thereof.

6. A beach umbrella comprising:

a folding radial frame;

a canopy stretched over the frame; and a telescopic shank, wherein:

the frame includes a hub provided on a top of the shank, a ring slidably provided on the shank below the hub, a plurality of ribs each including a first segment, a second segment, a third segment, a first hinge pivotably interconnecting the first and the second segments, and a second hinge pivotably interconnecting the second and the third segments, and a plurality of spreaders each having one end pivotably connected to the first segment and the other end pivotably connected to the ring wherein the first, the second, and the third segments are substantially parallel in response to folding the hinges in a folding position of the frame; and the shank is made of plastic and includes an upper support tube, a lower sliding tube adapted to slide in the support tube, and a rotatable locking device provided on a top of the sliding tube wherein the sliding tube is adapted to manually raise or lower to a plurality of vertical positions relative to the support tube, and the sliding tube is adapted to be locked in a selected one of the vertical positions.

wherein the first hinge is made of plastic and includes a first unit having one end fixedly connected to a free end of the first segment, and a second unit having one end pivotably connected to an other end of the first unit and an other end thereof fixedly connected to one end of the second segment; and wherein the second hinge is made of plastic and includes a first unit having one end fixedly connected to a free end of the second segment, and a second unit having one end pivotably connected to an other end of the second unit and an other end thereof fixedly connected to one of the third segment;

wherein the first unit is substantially Y-shaped and includes a tunnel having a bifurcation extending to opposing one end, a bar across an opening of the bifurcation, and a channel defined by the bifurcation and the bar;

wherein the bar is not aligned with a center line of the channel and tunnel of the first unit; and wherein the tunnel has a larger opening and a smaller opening each in communication with the tunnel.

7. The beach umbrella of claim 6, wherein the first unit further includes a narrow locking opening in communication with the tunnel for positioning the second unit in an extended state of the hinge.

8. The beach umbrella of claim 7, wherein the narrow locking opening has two arcuate necks each formed at a joining portion of the tunnel and the larger opening.

9. The beach umbrella of claim 7, wherein the second unit is substantially of U-section and includes a cylindrical extension projected from one end, an intermediate recess having an arcuate section in its bottom, the recess being adapted to receive the bar with the extension disposed in the tunnel and stopped by the narrow locking opening, and a bore through the other end and the recess and terminated at one end proximate the extension, the bore being adapted to fixedly receive one end of the second segment for confining the bar in the recess.

10. The beach umbrella of claim 9, wherein wherein the locking device is fixedly provided on the top of the sliding tube and is concealed by the support tube, the locking device includes a barbell-shaped member sized to slidably fit in the support tube, the barbell-shaped member including a lower cylindrical extension matingly secured to the top of the sliding tube, an eccentric shaft interconnected its top and bottom enlargements, and a protrusion formed on a shoulder between the shaft and the bottom enlargement; and a flexible, eccentric C-shaped member fitted around the shaft;

wherein the C-shaped member further includes an arcuate thick portion, an arcuate thin portion, a recessed flexible connection interconnected the thick and the thin portions, and a stop on an inner wall of the thin portion proximate an opening thereof.

* * * * *